US005398439A

United States Patent [19]

Harless

[11] Patent Number: 5,398,439

[45] Date of Patent: Mar. 21, 1995

[54] EXPENDED BRASS CATCHER

[75] Inventor: Clyde R. Harless, Taft, Tex.

[73] Assignee: The United States of America as represented by the Secretary of the Army, Washington, D.C.

[21] Appl. No.: 96,497

[22] Filed: Jul. 26, 1993

[51] Int. Cl.[6] ..... F41A 9/60
[52] U.S. Cl. ..... 42/98
[58] Field of Search ..... 42/90, 98, 106; 89/33.4

[56] References Cited

U.S. PATENT DOCUMENTS

| | | | |
|---|---|---|---|
| 4,028,834 | 6/1977 | Dobson | 42/98 |
| 4,166,333 | 9/1979 | Kratzer | 42/98 |
| 5,138,787 | 8/1992 | Riddle et al. | 42/98 |

OTHER PUBLICATIONS

The American Rifleman, "Colt Air Combat Pistol", Jun. 1976, vol. 124, No. 6, p. 44.

*Primary Examiner*—Stephen C. Bentley
*Attorney, Agent, or Firm*—Anthony T. Lane; Howard G. Garner; Hugh P. Nicholson

[57] ABSTRACT

A receptacle for receiving expended brass casing ejected from a weapon having an ejection port as the weapon is discharged. The invention comprises a hollow receptacle which is appended to the weapon with a shell casing receiving port in communication with the ejection port of the weapon for receiving shell casings ejected therefrom. The invention includes readily releaseable attaching means to permit easy emptying of the receptacle.

4 Claims, 5 Drawing Sheets

EXPENDED BRASS CATCHER

DEDICATORY CLAUSE

The invention described herein may be manufactured, used, and licensed by or for the Government for governmental purposes without the payment to me of any royalties thereon.

BACKGROUND OF THE INVENTION

This invention relates to a receptacle for attachment to a rifle for catching and retaining expended brass shell casings as the rifle is fired. More particularly this invention relates to a receptacle for attachment to rifles such as the M-16A1 at a point adjacent to the discharge port of the rifle for discharging expended brass shell casings. The shell casings catcher is removably attached to the rifle and can be removed for purposes of emptying expended, brass received from the rifle.

In the past, it has been very difficult to recover the expended brass shell casings, especially when those are discharged from rifles during maneuvers or live fire problems performed in open terrain during training exercises. The brass casings expended by the rifle are valuable and need to be recovered. In the past, such recovery has been accomplished only by having the area, where the live-fire problem or other exercises have been run, carefully policed up by the troops. Even with due diligence, however, it has been difficult to recover more than 10 or 15 percent of the expended brass.

SUMMARY OF THE INVENTION

The invention resolves the problem of recovering the expended brass shell casings without the need to police the area after the fire problems are completed. The invention provides a receptacle for attachment to the rifle which has an opening to receive expended brass shell casings from the discharge port of the rifle as the rifle is fired. The expended shell casings are expelled into the opening of the receptacle and retained therein until the receptacle is filled. After the receptacle is filled, it may be quickly removed and emptied into suitable containers to retrieve the brass shell casings.

The expended shell casing catcher of the invention may be formed from either plastic or metal by either cutting and welding the various elements of the casing or by injection molding or some other suitable process.

BRIEF DESCRIPTION OF THE DRAWINGS

The invention will now be described in conjunction with the attached drawings, in which.

DETAILED DESCRIPTION OF THE INVENTION

Figure 1:
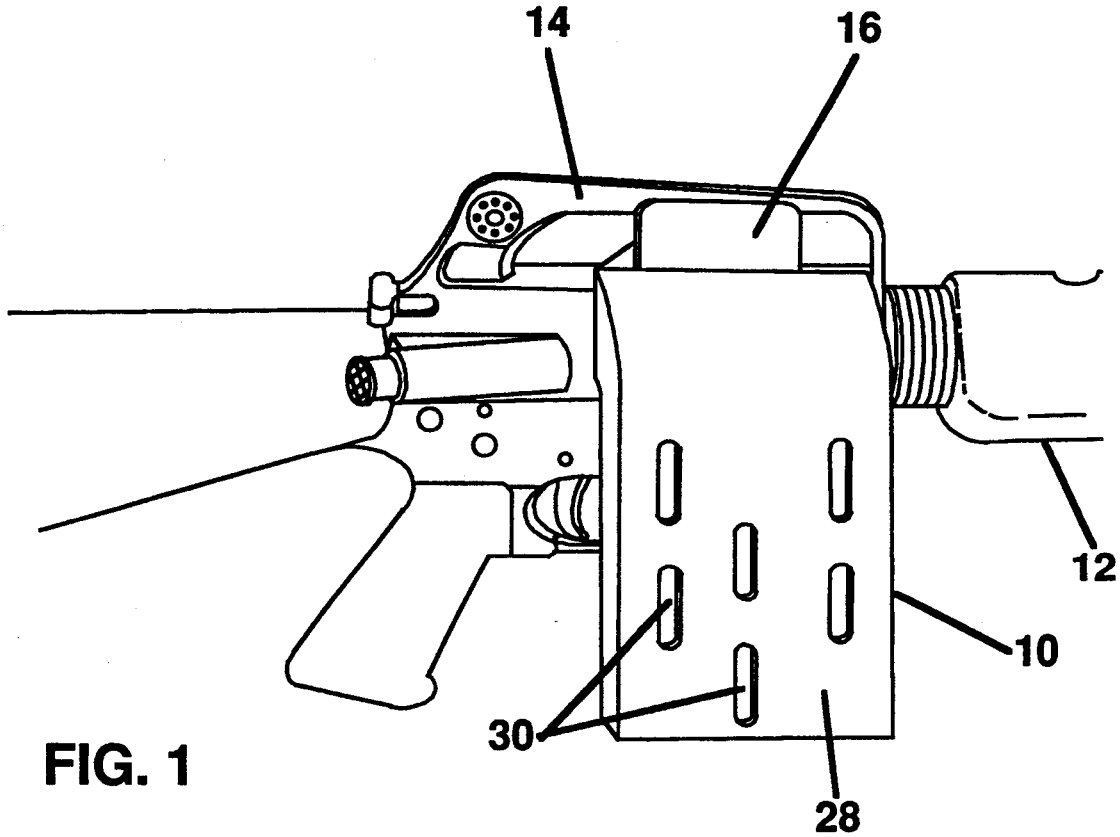
FIG. 1 is a front perspective view of a rifle with the shell casing catcher in place.
Figure 2:
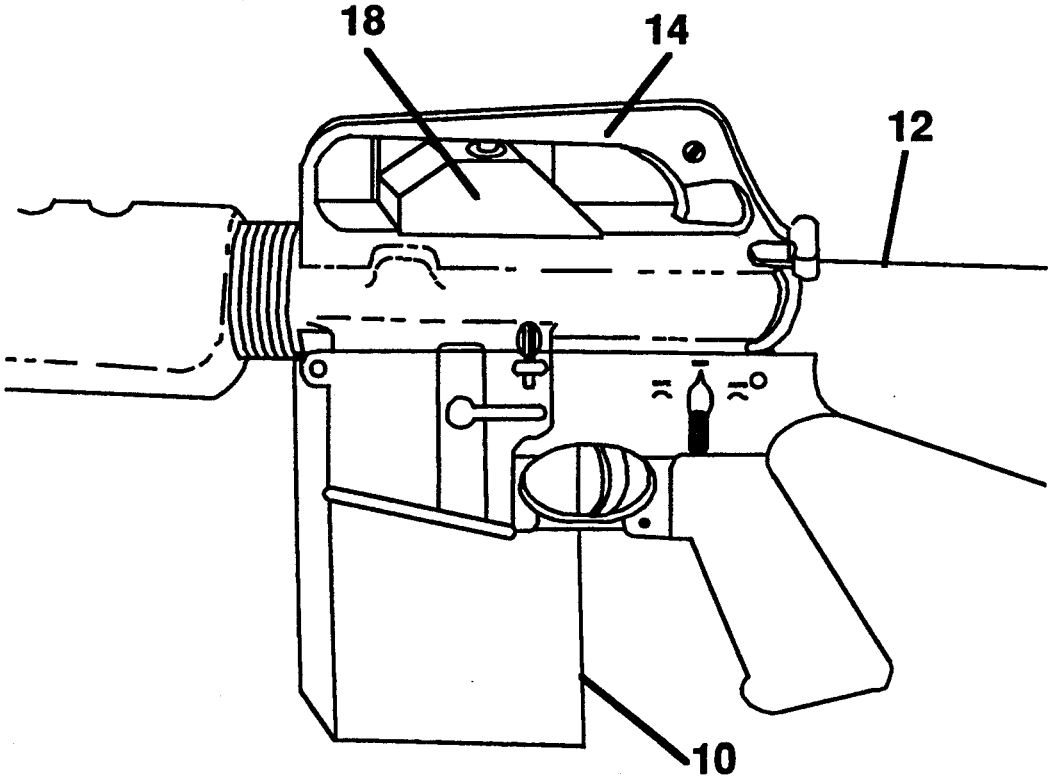
FIG. 2 is a view similar to FIG. 1 but showing the reverse side of the rifle with the shell casing catcher attached thereto.
Figure 3:
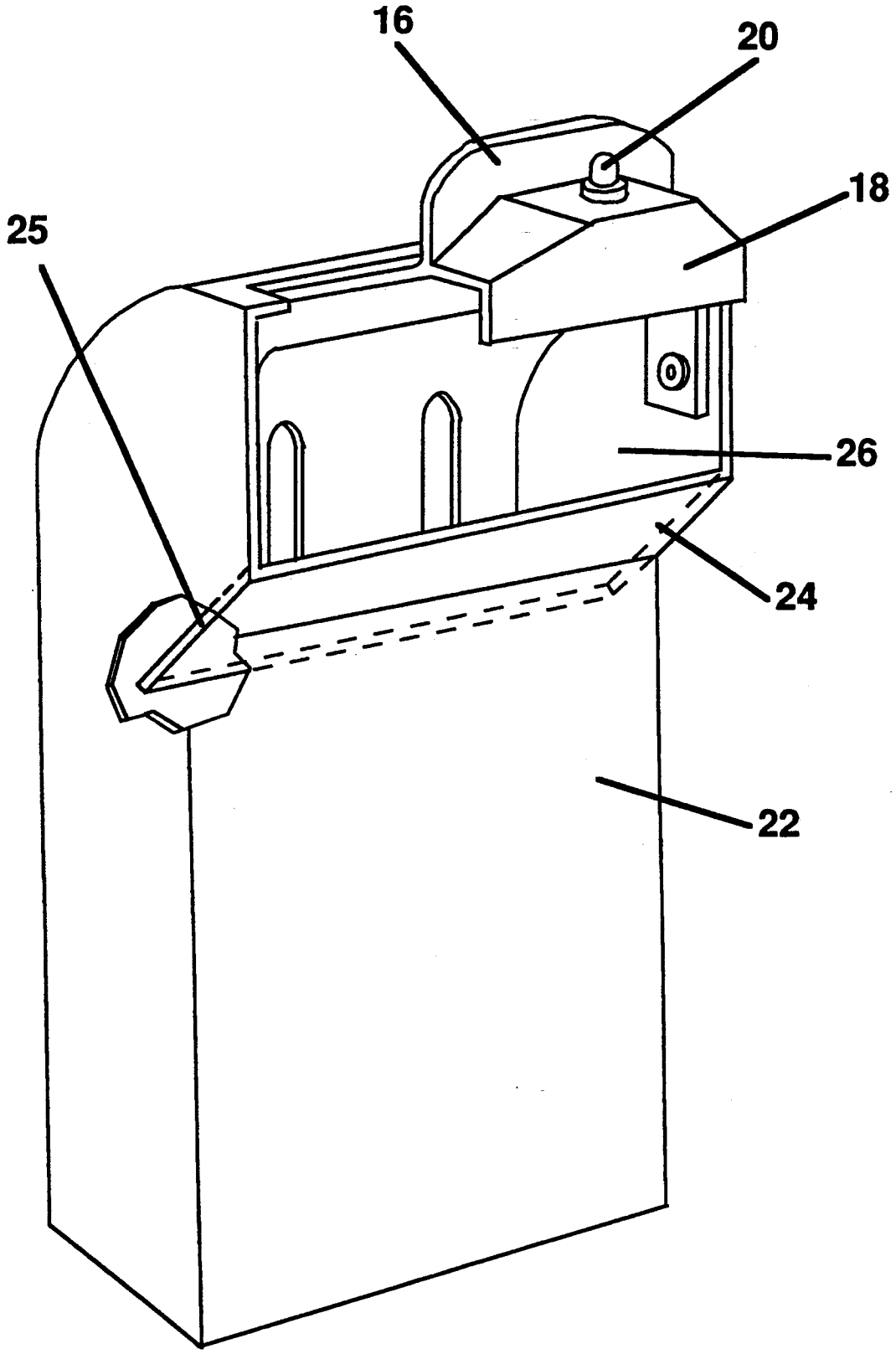
FIG. 3 is a perspective view of the expended shell casing catcher of the invention apart from the rifle.
Figure 4:
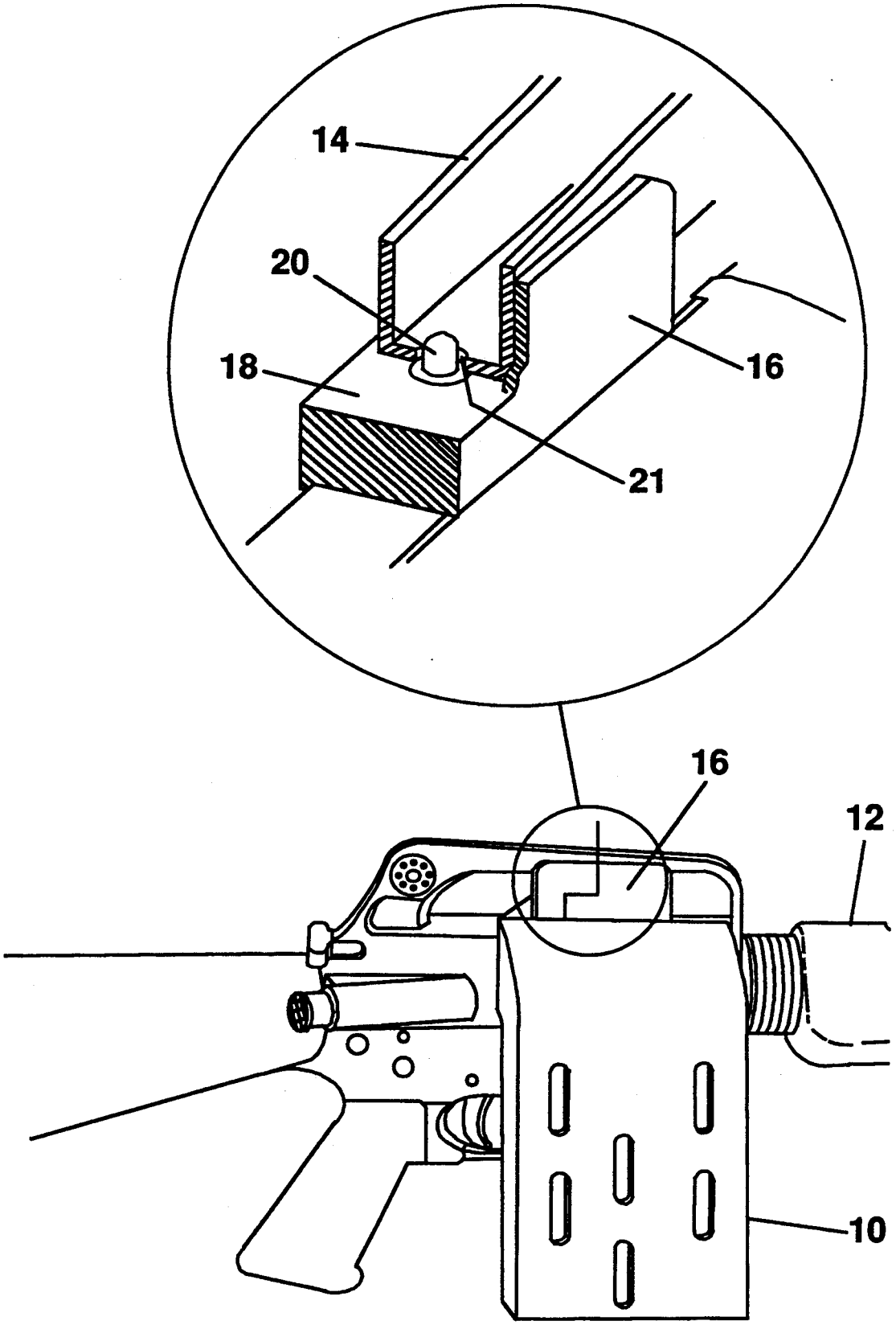
FIG. 4 is a view similar to that of FIG. 1, showing an enlarged perspective of the attachment device to clarify the manner in which the shell casing catcher is attached to the rifle.

Referring now to FIGS. 1, 2, 3, and 4 of the drawings wherein a first embodiment of the invention is illustrated and an expended shell casing catcher 10 is shown mounted on a rifle 12 such as an M-16A1. The rifle 12 has a carrying handle 14 affixed thereto and the shell casing catcher 10 has an attaching member bracket 16 attached to the shell casing catcher and having means for engaging the space in handle 14 and for locking the shell casing catcher to rifle 12 at a point adjacent to, and corresponding with the shell ejection port of the rifle 12 (not seen).

The attaching member 16 comprises a plate which fits against one side of handle 14 and has an attaching locking member 18 for fitting within the space of the handle 14. At the top of locking member 18 is a spring loaded detent 20 for engaging an opening 21 for holding bracket 16 in its engagement with handle 14 and thereby holding the expended shell casing catcher 10 in the correct position adjacent to the discharge port of rifle 12. In this position, as rifle 12 is fired, the expended brass shell casing is expelled through the discharge port of the rifle and is received by the shell casing catcher and retained therein. An inwardly projecting inclined back wall 24 forms a guide for guiding expended brass into the brass catcher 10. An extension portion 25 of wall 24 extends into the catcher 10 a distance which permits expended brass to pass into the catcher 10 but prevents it from rebounding out of the catcher when the catcher is vertical. However, the extension portion readily permits catcher 10 to be emptied as needed. Whenever it is desired or necessary to empty the shell casing catcher 10, it may be quickly removed by depressing detent 20.

Figure 5:
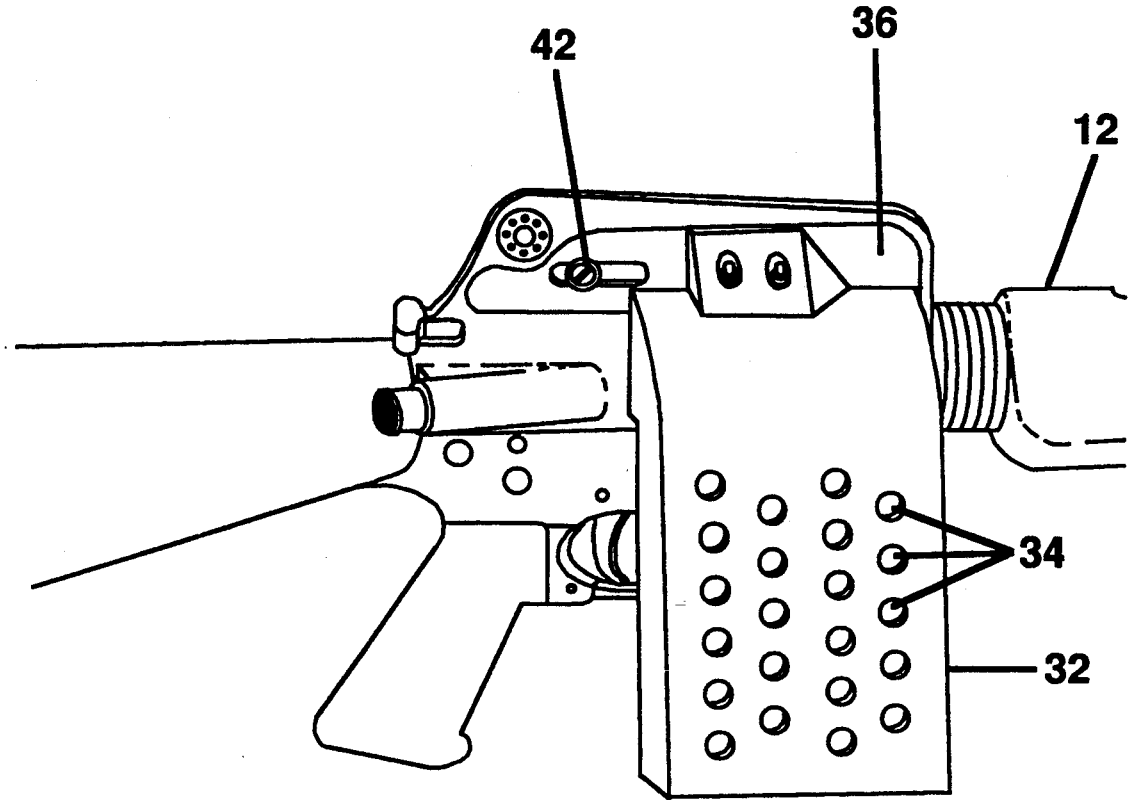
FIG. 5 is a view similar to that of FIG. 1 showing an alternative mounting device for the shell casing catcher of the invention.
Figure 6:
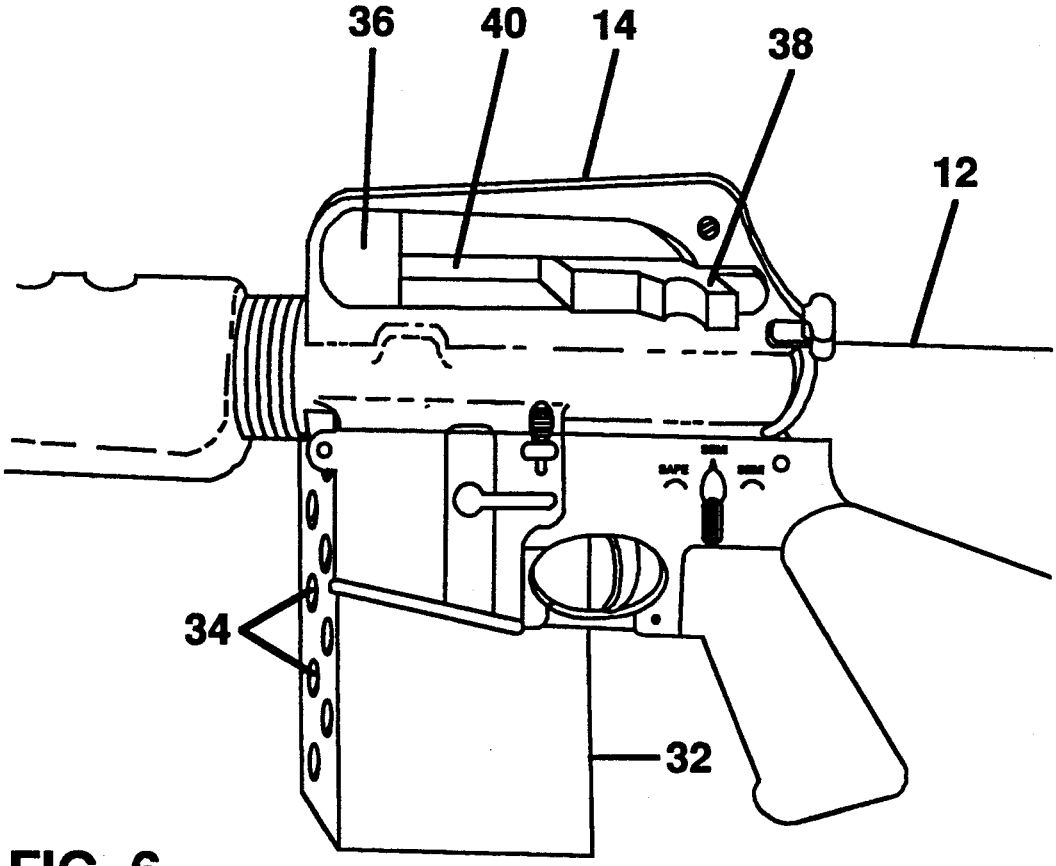
FIG. 6 is a view similar to that of FIG. 2 illustrating details of the alternative means for attaching the shell casing catcher to the rifle.
Figure 7:
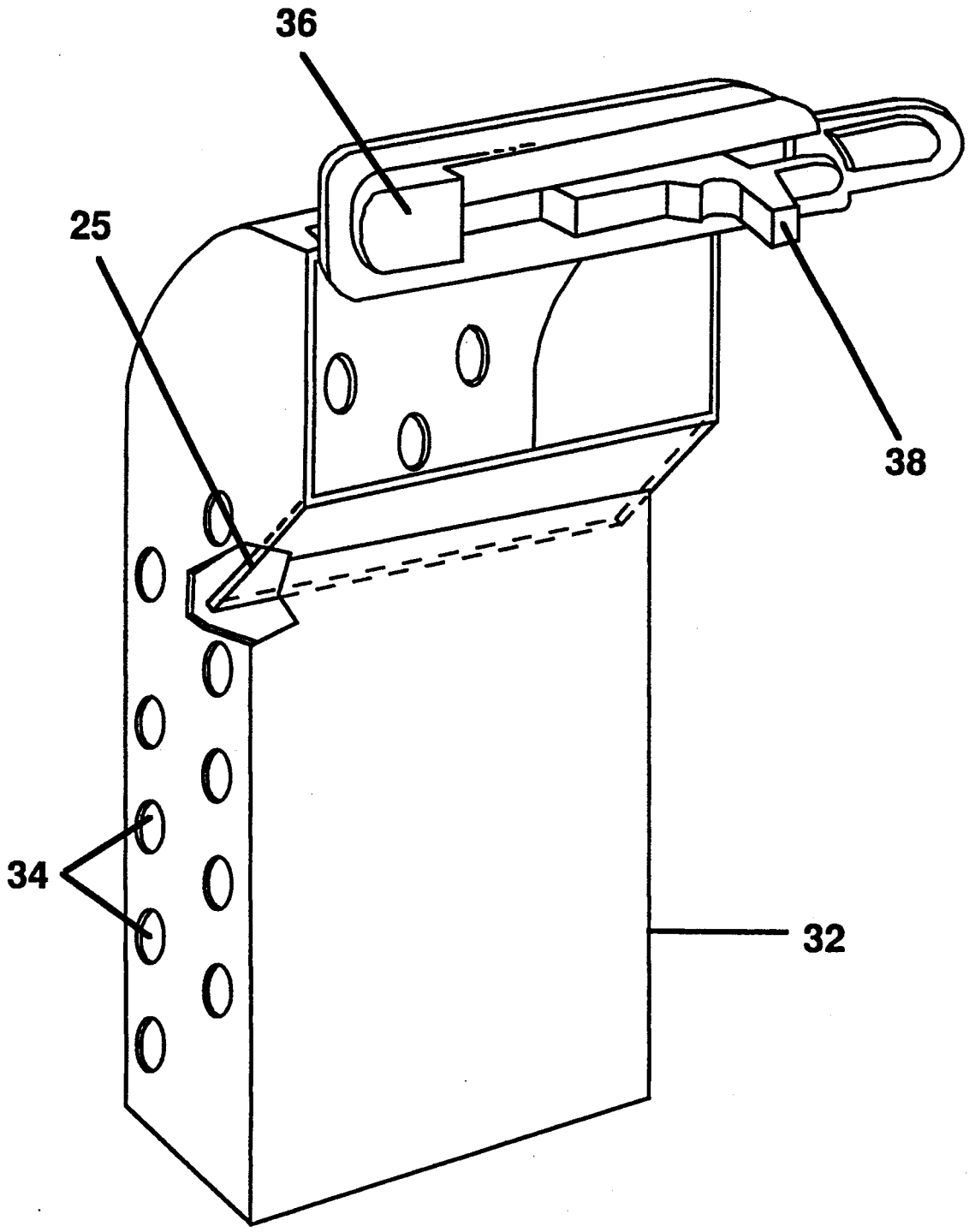
FIG. 7 is a view similar to that of FIG. 3 showing details of the alternative device for attaching the shell casing catcher to the rifle.

Referring now to FIGS. 5, 6, and 7 of the drawings, wherein a second embodiment of the invention is illustrated. In this embodiment the shell casing catcher is substantially of the same configuration as that of the first embodiment, but the means for attaching the shell casing catcher to the rifle is different. In this embodiment the alternate shell casing catcher 32 is fixed to a latching bracket 36. The shell casing catcher has round gas openings 34 rather than the elongated openings 30 illustrated in the first embodiment. The locking bracket 36 is adapted to fit in the space between handle 14 and the rifle and comprises a sliding latch bolt 38 which is slidingly mounted in a latch groove 40 for movement along its longitudinal axis to engage a portion of the opposite of handle 14 for locking the shell casing catcher in place. After the latch bolt 38 is moved into the locking position, a lock nut 42 locks it in place. Whenever the catcher 32 is filled with expended shell casings, the catcher is easily removed from the rifle for purposes of emptying the contents thereof.

With each of the embodiments of Applicant's invention, it should be noted that the width of the shell casing catcher is substantially the same of the length of the shell casing received therein. This is to permit their ready access into the receiving opening 26 and into the receptacle portion of the shell casing catcher. It will be noted that the gas openings 30 and 34 are of different shape and the shape of the openings is not critical to the performance of the invention. However, openings 30 and 34 are smaller than the expended shell casings adapted to be stored therein.

It will also be understood that capacity of the shell casing catcher may vary in accordance with the weapons to which it is applied. For example with the M-16A1 rifle, the capacity of the catcher will always exceed that of a single magazine for the rifle so that it will not have to be emptied too often. With the case of its application to machine guns and the like, it will be obvious that the capacity of the receptacle portion of the shell casing catcher must be greatly increased. These modifications can be readily made by those skilled in the art and the invention is not limited to the embodiments described herein. Rather, the scope of the invention is limited only by the claims appended hereto.

I claim:

1. A receptacle for receiving expended shell casings from a weapon having an injection port, as said weapon is being discharged, comprising:

a) an elongated hollow body having a plurality of rigid walls, one of which has a shell casing receiving opening for communicating with said ejection port when said receptacle is supported by said weapon;

b) a bottom for enclosing the lower portion of said hollow body and a top for enclosing the upper portion of said hollow body;

c) a plurality of openings, each of which is smaller than said shell casings, in one of said walls for permitting hot gases to escape from said receptacle as said shell casings are ejected from said weapon; and d) attaching means for fastening said receptacle to said weapon and for holding it in place where said ejection port and said receiving opening are maintained in communication for receiving and retaining expended shell casings, comprising a support member for engaging an opening on said weapon Which has a sliding bolt assembly for holding said support member in said opening.

2. A receptacle as set forth in claim 1, wherein said opening on said weapon is the space between said weapon and a handle for carrying said weapon.

3. A weapon having a shell ejection port for ejecting expended shell casings when said weapon is discharged, and having a receptacle for receiving and retaining said expended shell casings as said weapon is discharged; said receptacle, comprising:

a) an elongated hollow body having a plurality of rigid walls, one of which has a shell casing receiving opening for communicating with said ejection port when said receptacle is supported by said weapon;

b) a bottom for enclosing the lower portion of said hollow body and a top for enclosing the upper portion of said hollow body;

c) a plurality of openings, each of which is smaller than said shell casings, in one of said walls for permitting hot gases to escape from said receptacle as said shell casings are ejected from said weapon; and d) attaching means for fastening said receptacle to said weapon and for holding it in place where said ejection port and Said receiving opening are maintained in communication for receiving and retaining expended shell casings, comprising a support member for engaging an opening on said weapon which has a sliding bolt assembly for holding said support member in said opening.

4. A weapon as set forth in claim 3, wherein said opening on said weapon is the space between said weapon and a handle for carrying said weapon.

* * * * *